US007510008B2

(12) United States Patent
Evans

(10) Patent No.: US 7,510,008 B2
(45) Date of Patent: Mar. 31, 2009

(54) METHOD AND APPARATUS FOR DECREASING DRAG FORCE OF TRIGGER MECHANISM

(76) Inventor: Robert W. Evans, 18740 Palm Beach Blvd., Montgomery, TX (US) 77356

( * ) Notice: Subject to any disclaimer, the term of this patent is extended or adjusted under 35 U.S.C. 154(b) by 106 days.

(21) Appl. No.: 11/778,441

(22) Filed: Jul. 16, 2007

(65) Prior Publication Data

US 2009/0020287 A1 Jan. 22, 2009

(51) Int. Cl.
*E21B 31/107* (2006.01)

(52) U.S. Cl. ..... 166/301; 166/178; 175/304

(58) Field of Classification Search ..... 166/178, 166/301; 175/304
See application file for complete search history.

(56) References Cited

U.S. PATENT DOCUMENTS 2,008,743 A * 7/1935 Black ..... 175/304
3,658,140 A * 4/1972 Berryman ..... 175/304
5,022,473 A * 6/1991 Taylor ..... 175/299
5,069,282 A * 12/1991 Taylor ..... 166/301
5,170,843 A * 12/1992 Taylor ..... 166/301
6,290,004 B1 9/2001 Evans
6,481,495 B1 11/2002 Evans
6,988,551 B2 1/2006 Evans
7,367,397 B2 * 5/2008 Clemens et al. ..... 166/301
2006/0169456 A1 8/2006 Evans

* cited by examiner

*Primary Examiner*—Hoang Dang
(74) *Attorney, Agent, or Firm*—Claude E. Cooke, Jr.; Burleson Cooke L.L.P.

(57) ABSTRACT

Method and apparatus for decreasing drag force in a mechanism for releasing a mandrel is provided. The mandrel is released by a collet, which is controlled by a trigger sleeve. Most of the axial force on the collet is relieved, thereby decreasing the frictional force exerted by the collet on the mandrel after it is released.

12 Claims, 4 Drawing Sheets

METHOD AND APPARATUS FOR DECREASING DRAG FORCE OF TRIGGER MECHANISM

BACKGROUND OF INVENTION

1. Field of the Invention

This invention relates to tools that may be used in wells. More particularly, method and apparatus are provided for decreasing drag force in the trigger mechanism (a collet, mandrel, sleeve combination) of a jar used for releasing stuck objects in a well.

2. Description of Related Art

Jars are tools that are widely applied in wells for releasing an object stuck in the well. Mechanical jars store potential energy in a support above the jar and use a release mechanism to apply the energy as an impact force on the housing of the jar. One form of release mechanism is a collet that is adapted to release a mandrel when a sleeve disengages, allowing a hammer on the mandrel to impact an anvil on the housing. Examples of jars employing a collet, collar and mandrel as a release mechanism are described in U.S. Pat. Nos. 6,290,004; 6,481,495; 6,988,551; and U.S. Patent Application No. 2006/0169456, all having common inventorship with the present disclosure.

Frictional forces decrease the efficiency of mechanical devices such as collet-and-mandrel combinations. The frictional force created by relative motion of the collet and mandrel can have a great effect on the operation of such apparatus. In a jar, frictional force can significantly affect the mechanical impulse applied to the equipment that is stuck. Frictional force can also retard the actions necessary to reset the device. Therefore, there is need for means to decrease frictional drag in devices employing a collet mechanism to restrain a mandrel and release it at a selected position.

Methods used to decrease frictional force include use of lubricating coatings on surfaces and immersing surfaces in lubricating fluids. A further way to decrease frictional drag between surfaces is to decrease the contact force between the surfaces. There is a need for method and apparatus for decreasing the contact force between a collet and a mandrel in apparatus, such as a jar, in which the collet is used to release the mandrel at a selected position.

BRIEF SUMMARY OF THE INVENTION

Method and apparatus are provided for decreasing drag force between a collet and a mandrel when the collet is used with the mandrel that moves to store mechanical energy and is then released from the collet to apply an impact force to a surrounding housing.

The same numerical designations in each figure refer to the same part.

DETAILED DESCRIPTION OF THE INVENTION

The basic mechanisms of the jars to which the invention is applicable are described in U.S. Pat. Nos. 6,290,004; 6,481,495; 6,988,551; and U.S. Patent Application No. 2006/0169456. All of these patents and the published patent application are hereby incorporated by reference herein.

The mechanisms described generally include a mandrel in a housing positioned concentrically about the mandrel and a collet locked to the mandrel when the jar is ready to begin a cycle of storing and releasing potential energy. The collet moves from a first to a second position as force is applied to the mandrel by the support for the jar, normally a wire line. The cylindrical body of the jar is normally held by an object that is stuck in a well and is to be "jarred" free, A main spring in the jar is compressed a selected distance, the main spring displacement d, by applying a force to the wire line, causing movement of the mandrel, until a "trigger mechanism" suddenly releases the mandrel from the collet, allowing the mandrel to move rapidly to a third position. This sudden release allows the jar to "fire," when a surface on the mandrel (the "hammer") impacts a surface on the housing of the jar (the "anvil"). Then force on the wire line is decreased and the mandrel returns to a position where it is again Socked into the collet and is prepared for returning to the first position for another stroke. Both the firing and the resetting of the mandrel require relative movement between the mandrel and the collet. The purpose of the methods and apparatus described herein is to decrease the frictional drag that occurs between the collet and the mandrel during both the firing and the resetting stages of the jar.

Figures 1A, 1B, 1C:
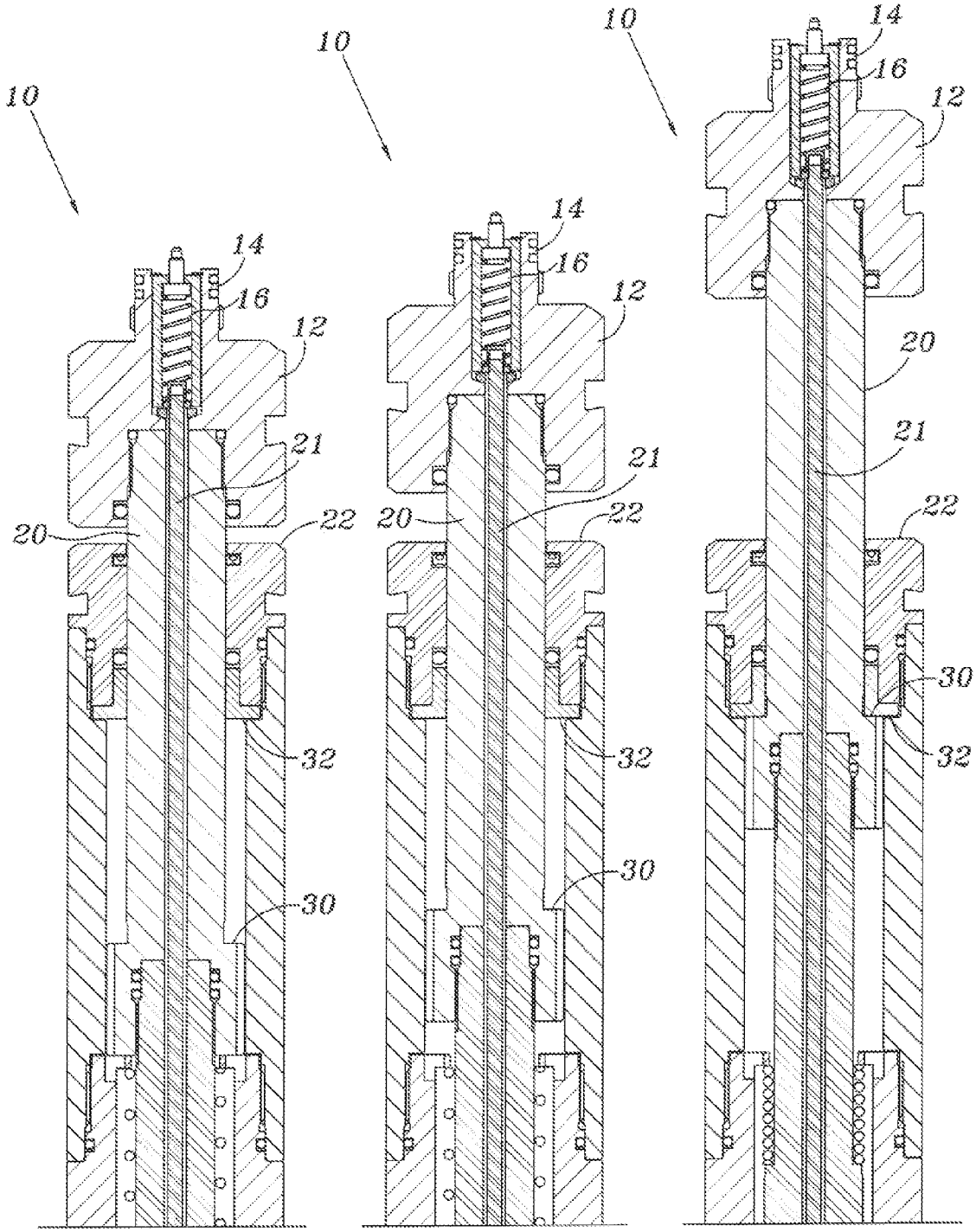
FIGS. 1A, 1B and 1C are cross-sectional views of the upper section of the jar in three different states during a cycle of use.

Referring to FIGS. 1A, 1B, and 1C, the upper section of jar 10 is shown. Head 12 is shown at three different positions, but housing 22 is at the same position in each FIG. In FIG. 1A, jar 10 is in a no-load position—mechanical energy has not been stored in the jar and mandrel 20 is at a first position. In FIG. 1B, head 12 and attached mandrel 20 have been pulled upward to a second position, while compressing a main spring and storing mechanical energy in the support for the jar, but the jar has not tired to release the energy. Mandrel 20 may contain conductor 21 for electrical signal or power transmission through jar 10. In FIG. 1C, the jar has fired, which means that mandrel 20 has been released to move to position three, where shoulder 30 (the "hammer") on mandrel 20 impacts shoulder 32 (the "anvil") in housing 22. To reset the jar, force on head 12 is decreased and mandrel 20 is allowed to drop back to where it can be reset in the release mechanism for another stroke. Under some conditions of use of jar 10, the weight available to lower mandrel 20 and reset the mandrel is small. Under these conditions the force resisting downward movement of the mandrel is preferably minimized so as to allow faster resetting.

Figures 2A, 2B, 2C:
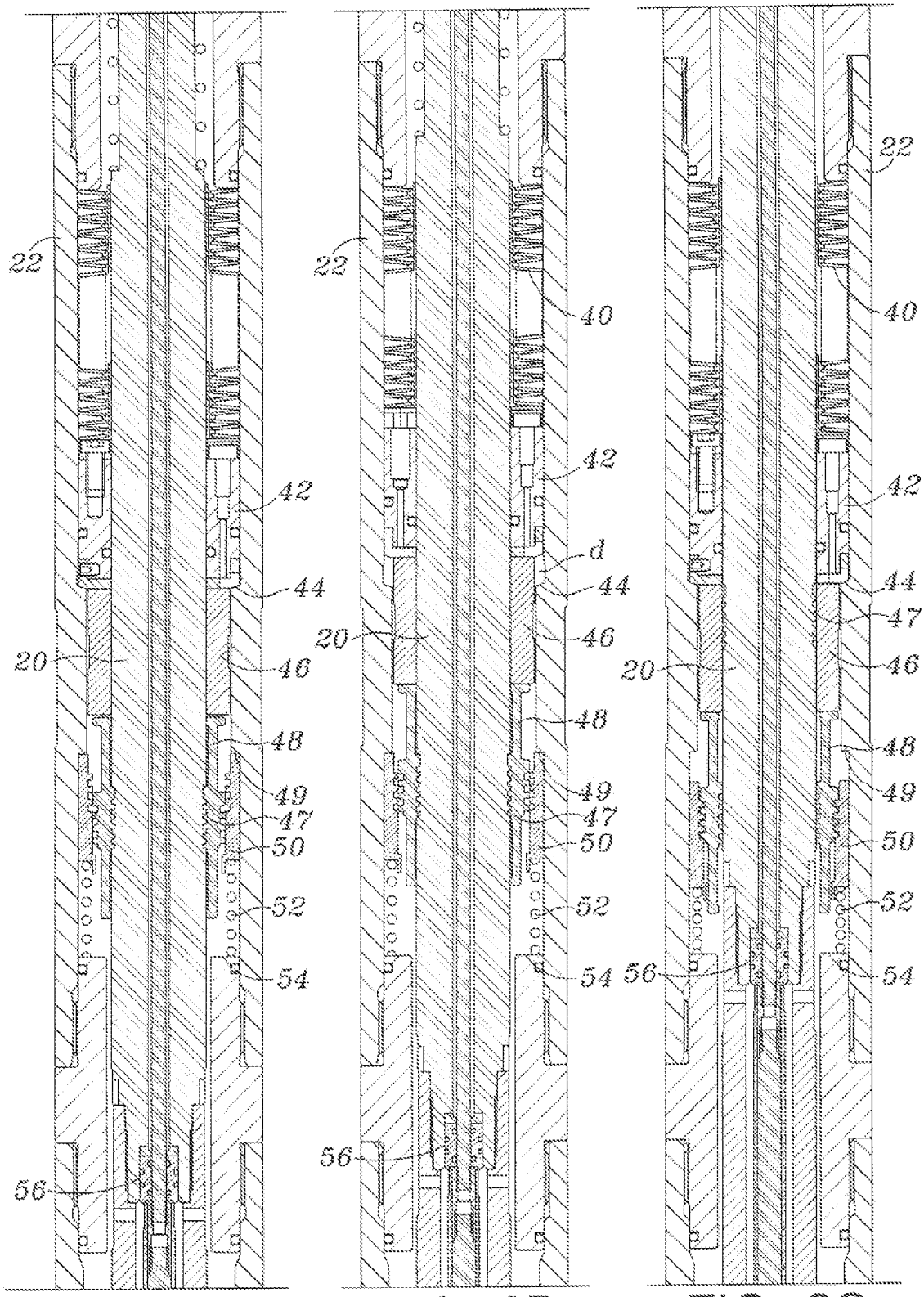
FIGS. 2A, 2B and 2C are cross-sectional views of the lower section of the jar in three different states during a cycle of use.

Now referring to FIGS. 2A, 2B and 2C, a lower segment of jar 10 is shown, which contains springs and the inventive trigger mechanism. Housing 22 of the jar is in the same position in each figure and is continuous with the housings shown in FIGS. 1A, 1B and 1C. This lower segment contains main spring 40 for resisting movement of mandrel 20 as it moves toward the release position. The force required to compress main spring 40 determines the amount of potential energy stored in the support for the jar. Main spring 40 may be a stack of Belleville springs. In FIG. 2A, main spring 40 of the jar has not been compressed beyond its initial load and mandrel 20 is in position 1. Main spring 40 is restrained at its lower end by piston 42 and piston 42 is resting on shoulder 44. Therefore, compression ring 46 and collet 48 are not under a compressive pre-load of main spring 40, if such load exists. Grooves 47 on the outside surface of mandrel 20 are engaged with or in registration with the cylindrical protuberances and grooves on the inside of collet 48. External cylindrical protuberances and grooves of collet 48 are not in registration with the cylindrical protuberances and grooves on the inside of trigger sleeve 50. This condition provides an inward, radial force from trigger sleeve 50 to overcome an outward radial force from collet 48 to maintain the cylindrical protuberances and grooves of collet 48 and the grooves of mandrel 20 in registration. Jar 10 is now set for application of upward force at head 12 to store energy in the support above the jar. Mandrel 20 and collet 48 are in their first position.

In FIG. 2B, upward force has been applied to head 12 of jar 10 to store mechanical energy in the support above the jar. This force may be applied by electric wireline, slick wireline, coil tubing or other means, while housing 22 of the jar is fixed to an object to be released. Jar 10 has not fired. Mandrel 20 has been moved upward to its second position, and it has moved with it collet 48, since the cylindrical protrusions and grooves on the inside of collet 48 are in registration with the grooves of mandrel 20. Collet 48, now in its second position, has driven compression ring 46, actuating piston 42 and the bottom of main spring 40 upward, moving the bottom of actuating piston 42 off shoulder 44 by the displacement, d, of main spring 40, shown in FIG. 2B. At this point the total force of main spring 40 is applied downwardly on collet 48. The outside flanges and grooves of collet 48 have been moved upward, while trigger sleeve 50 has been restrained from upward movement by shoulder 49. When the outside cylindrical protrusions and grooves of collet 48 are moved enough to come in registration with the grooves of trigger sleeve 50, collet 48 expands, releasing the grooves on mandrel 20 and allowing mandrel 20 to move upward very rapidly to its third position, which is shown in FIG. 2C. This is the "firing" of the jar. Before mandrel 20 has moved very far upward after collet 48 expands, actuating piston 42 has moved downward the distance, d, to shoulder 44, driven by the expansion of main spring 40 and pressure above the piston. Shoulder 44 allows the axial force on collet 48 to be relieved of the force of main spring 40. Actuating piston 42 has driven collet 48 downward by distance d and because die cylindrical protrusions and grooves on the outside of collet 48 remain in registration with trigger sleeve 50, the trigger sleeve moves down distance d with the collet. Trigger sleeve 50 is affixed to or in contact with auxiliary spring 52, which may be a coil spring, and auxiliary spring 52 applies an upward force to trigger sleeve 50 that is much less than the force of main spring 40. Preferably, the force of auxiliary spring 52 after compression the distance d is in the range from about 50 pounds to about 200 pounds. Auxiliary spring 52, in combination with shoulder 44, performs the important function of allowing axial force on collet 48 to be reduced from the axial force that is applied by main spring 40 to the axial force applied by auxiliary spring 52. Auxiliary spring 52 is supported by shoulder 54 of housing 22. Pressure bulkhead 56 is disposed at the bottom of mandrel 20. The working compression range of auxiliary spring 52, where it exhibits elastic behavior, is selected to be greater than the total displacement, d, of main spring 40 from its maximum to minimum compression position. The magnitude of the advantage of reducing axial force on collet 48 while mandrel 20 is moving will be discussed in more detail below. In prior art jars employing the collet-mandrel-sleeve trigger mechanism disclosed herein, the working compression range of auxiliary spring 52, which was usually a wave spring, was not sufficient to allow piston 42 to return to shoulder 44 to relieve the axial force on collet 48 prior to impact and during resetting of the trigger mechanism. This allowed the force of main spring 40 to be exerted on collet 48 during movement of mandrel 20.

The operation of actuating piston 42 is explained in U.S. Pat. No. 6,290,004. The piston provides a mechanism for substantially sealing the portion of the fluid chamber disposed above the piston to permit a buildup of pressure in the housing. The upper movement reduces the volume between the mandrel 20 and housing 22 above piston 42, which causes an increase in the internal pressure of that portion of the housing, thereby generating an axial force to resist the relative movement and allow a larger force to build up more potential energy than is possible by use of main spring 40 alone. Annular piston 42 contains two parallel flow passages, one of which permits the restrictive flow of fluid from the portion of the housing above piston 42 and the other permitting flow in the opposite direction when the jar is reset.

Figure 3:
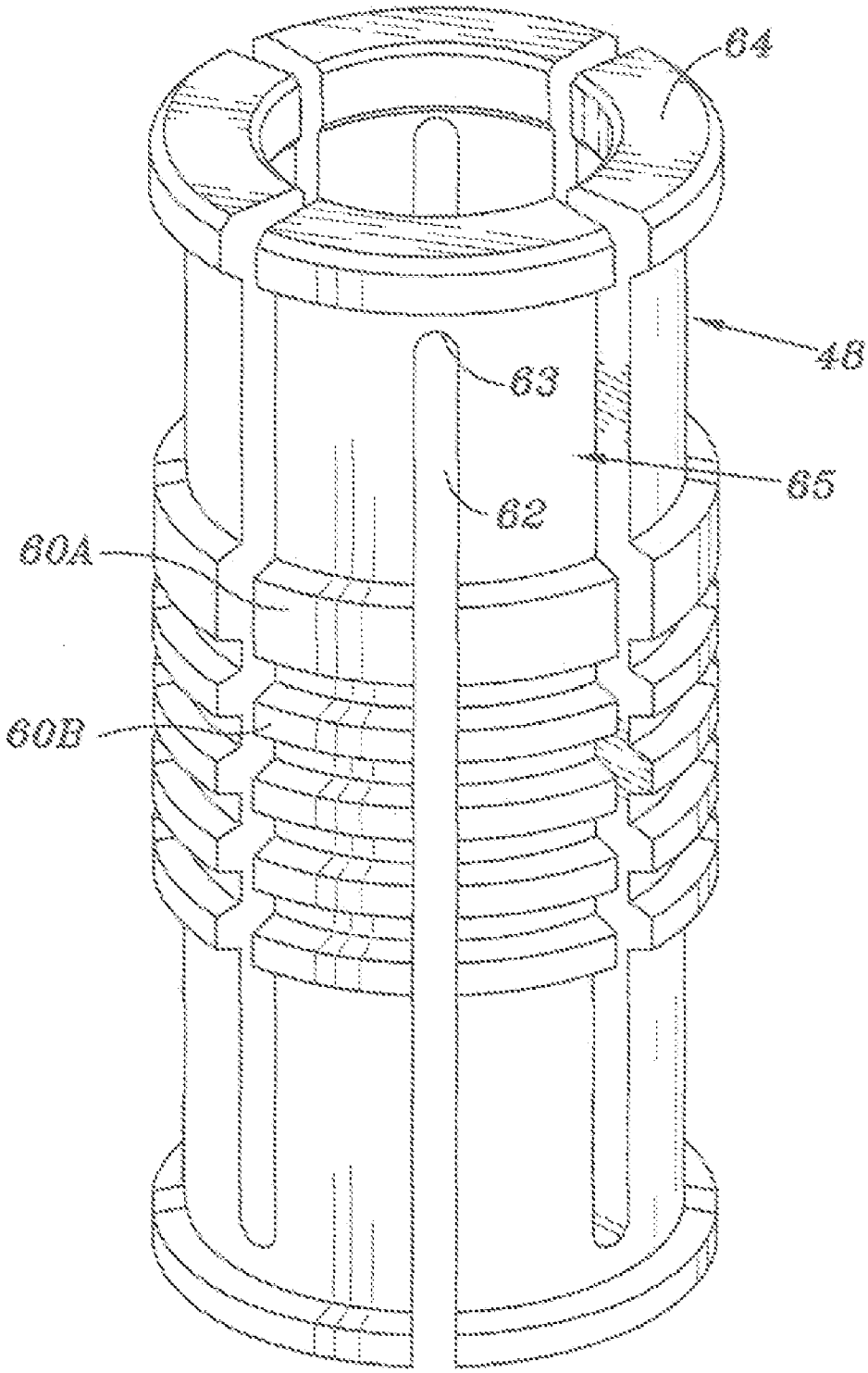
FIG. 3 is an Isometric view of the collet.

The triggering and resetting of the collet require that the cylindrical protrusions on the outside and the inside of the collet have surfaces on each side of the protrusions that are sloped. FIG. 3 shows collet 48 that may be used for a jar or other purposes. Slots 62 in the collet allow a weak spring action to allow the collet to expand or contract as matching protrusions and grooves are moved axially to either move into registration or out of registration with the cylindrical protrusions and grooves of the collet. Cylindrical protrusions 60 on the outside of collet 48 may include primary protrusion 60A and secondary protrusions 60B. Similar protrusions inside collet 48 cannot be seen in FIG. 3 but are illustrated in FIG. 2 in cross-section. The movement of matching grooves in trigger sleeve 50 into registration with the external cylindrical protrusions and grooves of the collet triggers the jar.

Figures 4A, 4B, 4C:
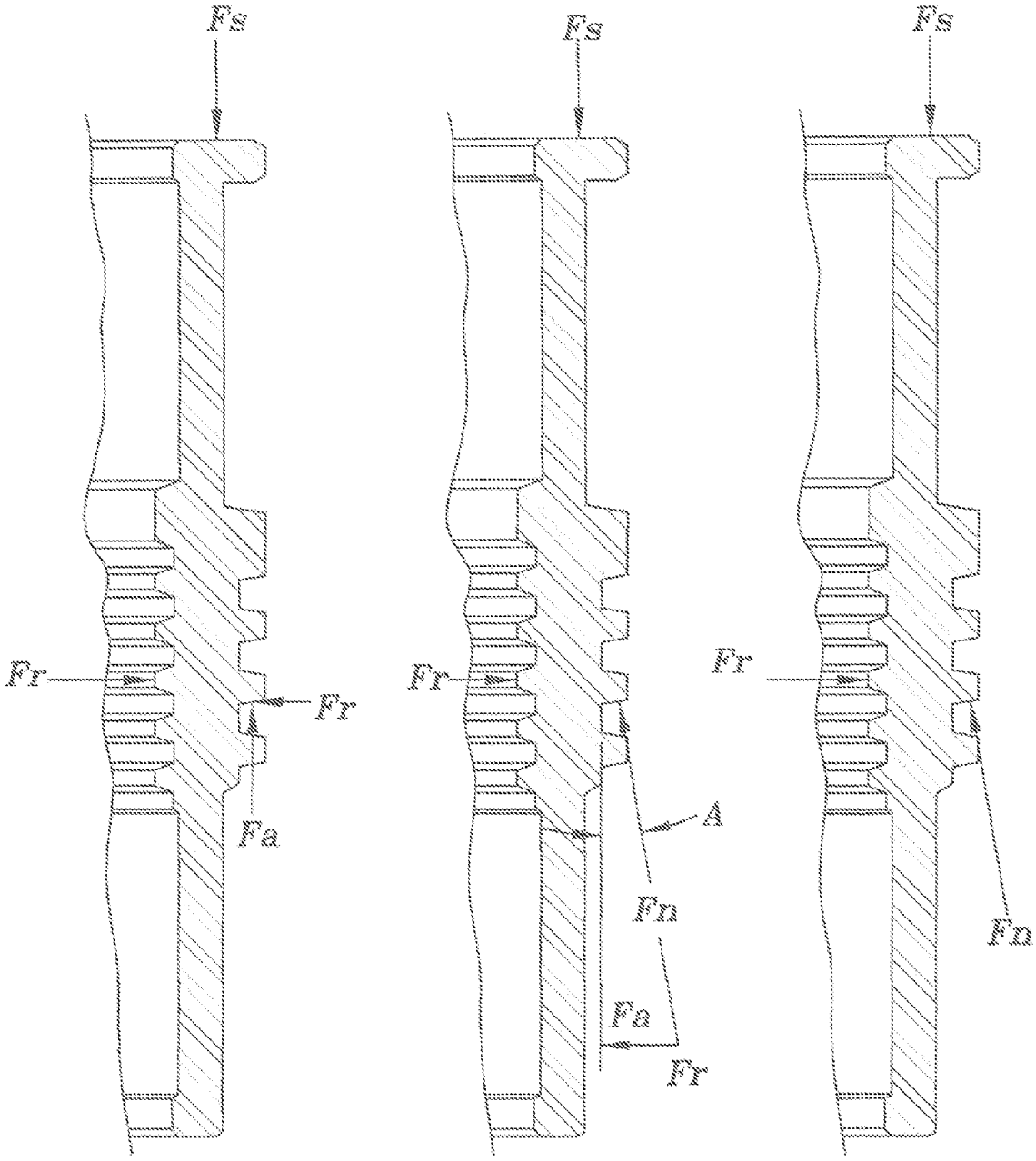
FIGS. 4A, 4B and 4C are cross-sectional views of the collet and trigger sleeve illustrating forces on the surfaces.

This slope on the cylindrical protrusions also results in a radial force inward on collet 48, as shown in FIG. 4A. The axial force $F_a$ opposes the spring force $F_S$. As illustrated in FIG. 4B, the vector F represents the force of trigger sleeve 50 (FIG. 2) on collet 48. That force is normal to the slope of the sides of the cylindrical protrusions. The radial force inward on the collet is the radial component of the force F as shown in FIGS. 4B and 4C, or $F_n$ tan A, where A is the slope of each shoulder. A usual range of slopes of the shoulders of cylindrical protrusions in such collets is around 14.5 degrees. Therefore, the radial force is about tan 14.5° or 0.26 times the spring force. The drag force on the mandrel moving through the collet is a function of the coefficient of friction, which ranges from 0.08 to 0.20 for steel sliding on steel. Assuming a drag coefficient of 0.2, the drag of the mandrel is about 0.2×0.26-0.05 or 5% of the spring force.

As explained above, in prior art jars, most or all of the force of the main spring is exerted on the collet while the mandrel is moving upward after the jar is tired and while the mandrel is moving downward for resetting. A common force from the main spring is in the range of 4000 pounds. The drag force is thus estimated to be in the range of 5% of 4000=200 pounds. This drag force significantly reduces the impulse generated by the jar and slows the fall of the mandrel for resetting. As disclosed herein, instead of the force of the main spring being exerted on the collet while the mandrel is moving, a shoulder (as shown at 44 of FIG. 2) relieves the main spring force from the collet and transfers the force to an auxiliary spring (such as shown at 52 of FIG. 2) that is exerting much less axial force. Since auxiliary spring 52 preferably exerts a force of not more than 200 pounds, for example, the drag force on the collet is reduced to less than 10 pounds.

Although the present invention has been described with reference to specific details, it is not intended that such details should be regarded as limitations on the scope of the invention, except as and to the extent that they are included in the accompanying claims.

The invention claimed is:

1. A jar, comprising:

a cylindrical body having an anvil therein;

a mandrel concentric inside the cylindrical body, the mandrel having a set of grooves at a selected position and a hammer;

a trigger sleeve disposed inside the cylindrical body, the trigger sleeve having grooves and protuberances in an inside diameter;

a collet disposed between the trigger sleeve and the mandrel, the collet having grooves and protuberances in an inside diameter adapted to come into registration with the grooves of the mandrel and grooves and protuberances on an outside diameter adapted to come into registration with the trigger sleeve;

a main spring in the cylindrical body disposed to apply a first axial force to the collet as the collet moves a selected displacement to compress the main spring until the grooves and protuberances on the outside diameter of the collet come into registration with the grooves and protuberances in the outside diameter of the trigger sleeve to release the mandrel;

a shoulder disposed to relieve the first axial force to the collet after the mandrel is released;

an auxiliary spring in the cylindrical body disposed to apply a second axial force to the trigger sleeve and the collet after the mandrel is released, the second axial force being less than the first axial force.

2. The jar of claim 1 further comprising an actuating piston disposed between the collet and the first spring.

3. The jar of claim 1 wherein the selected displacement of the collet is within the elastic compression range of the auxiliary spring.

4. The jar of claim 1 wherein the main spring is a stack of Belleville springs.

5. The jar of claim 1 wherein the second axial force is less than 200 pounds.

6. A release mechanism for a mandrel, the mandrel being adapted to move within a body and having a set of grooves at a selected position, comprising:

a trigger sleeve disposed outside the mandrel, the trigger sleeve having grooves and protuberances in an inside diameter;

a collet disposed between the trigger sleeve and the mandrel, the collet having grooves and protuberances in an inside diameter adapted to come into registration with the grooves of the mandrel and grooves and protuberances on an outside diameter adapted to come into registration with the trigger sleeve;

a main spring disposed to apply a first axial force to the collet as the collet moves a selected displacement within the body to compress the main spring until the grooves and protuberances on the outside diameter of the collet come into registration with the grooves and protuberances in the outside diameter of the trigger sleeve to release the mandrel;

a shoulder disposed to relieve the first axial force on the collet after the mandrel is released; and an auxiliary spring disposed to apply a second axial force to the trigger sleeve and the collet after the mandrel is released, the second axial force being less than the first axial force.

7. The release mechanism of claim 6 wherein the displacement of the main spring is less than the elastic compression range of the auxiliary spring.

8. The release mechanism of claim 6 wherein the main spring is a stack of Belleville springs.

9. The release mechanism of claim 6 wherein the second axial force is less than 200 pounds.

10. A method for releasing a mandrel disposed within a body and having a set of grooves at a selected position on the mandrel, comprising:

placing a trigger sleeve outside the mandrel, the trigger sleeve having grooves and protuberances in an inside diameter and being adapted to move a selected displacement in the body;

placing a collet between the trigger sleeve and the mandrel, the collet having grooves and protuberances in an inside diameter adapted to come into registration with the grooves of the mandrel and grooves and protuberances on an outside diameter adapted to come into registration with the trigger sleeve;

placing a main spring in the body disposed to be compressed by axial displacement of the collet and trigger sleeve, thereby exerting a force of the main spring on the collet and trigger sleeve until the mandrel is released by movement of the trigger sleeve through the selected displacement;

placing a shoulder in the body disposed to relieve the force of the main spring on the collet and trigger sleeve after the mandrel is released; and placing a second spring to apply a second axial force to the collet after the mandrel is released and the first axial force is relieved, the second axial force being less than the first axial force.

11. The method of claim 10 wherein the selected displacement of the trigger sleeve is less than the selected displacement of the second spring.

12. The method of claim 10 wherein the second axial force is less than 200 pounds.

* * * * *